US005607378A

United States Patent [19]

Winston

[11] Patent Number: 5,607,378

[45] Date of Patent: Mar. 4, 1997

[54] METHOD OF EXERCISING A SELECTED MUSCLE

[76] Inventor: Edith Winston, 135 Hazelwood Dr., Jericho, N.Y. 11753

[21] Appl. No.: 600,277

[22] Filed: Feb. 12, 1996

Related U.S. Application Data

[63] Continuation of Ser. No. 343,088, Nov. 21, 1994, abandoned.

[51] Int. Cl.[6] ..... A63B 21/02; A63B 21/065

[52] U.S. Cl. ..... 482/105; 482/124; 482/121; 482/139

[58] Field of Search ..... 482/105, 124, 482/139, 121

[56] References Cited

U.S. PATENT DOCUMENTS

| | | | |
|---|---|---|---|
| 3,588,105 | 6/1971 | Donohoe | 482/105 |
| 4,180,261 | 12/1979 | Kolka | 482/105 |
| 4,355,801 | 10/1982 | Thomsen | 482/105 |
| 4,592,358 | 6/1986 | Westplate | 482/105 |
| 4,756,525 | 7/1988 | Whitsitt | 482/105 |
| 4,905,991 | 3/1990 | Alston | 482/105 |
| 4,923,418 | 5/1990 | Hoffman | 482/105 |
| 4,966,365 | 10/1990 | Winston | 482/105 |
| 5,010,596 | 4/1991 | Brown et al. | 482/105 |
| 5,127,891 | 7/1992 | Winston | 482/105 |
| 5,207,635 | 5/1993 | Richards et al. | 482/124 |
| 5,383,235 | 1/1995 | Peters | 482/105 |
| 5,514,056 | 5/1996 | Ronca et al. | 482/105 |

FOREIGN PATENT DOCUMENTS

| | | | |
|---|---|---|---|
| 92/10242 | 6/1992 | WIPO | 482/105 |

OTHER PUBLICATIONS

American Heart Association, Swimming for a Healthy Heart.

*Primary Examiner*—Richard J. Apley
*Assistant Examiner*—Victor K. Hwang
*Attorney, Agent, or Firm*—Myron Amer P.C.

[57] ABSTRACT

A method of exercising a selected muscle, e.g. the biceps, using exercise weights embodied in a device having a limb-encircling stretchable band for both establishing an attached position overlying the selected muscle and also exerting external pressure upon the encircled limb muscle during the exercise routine.

1 Claim, 2 Drawing Sheets

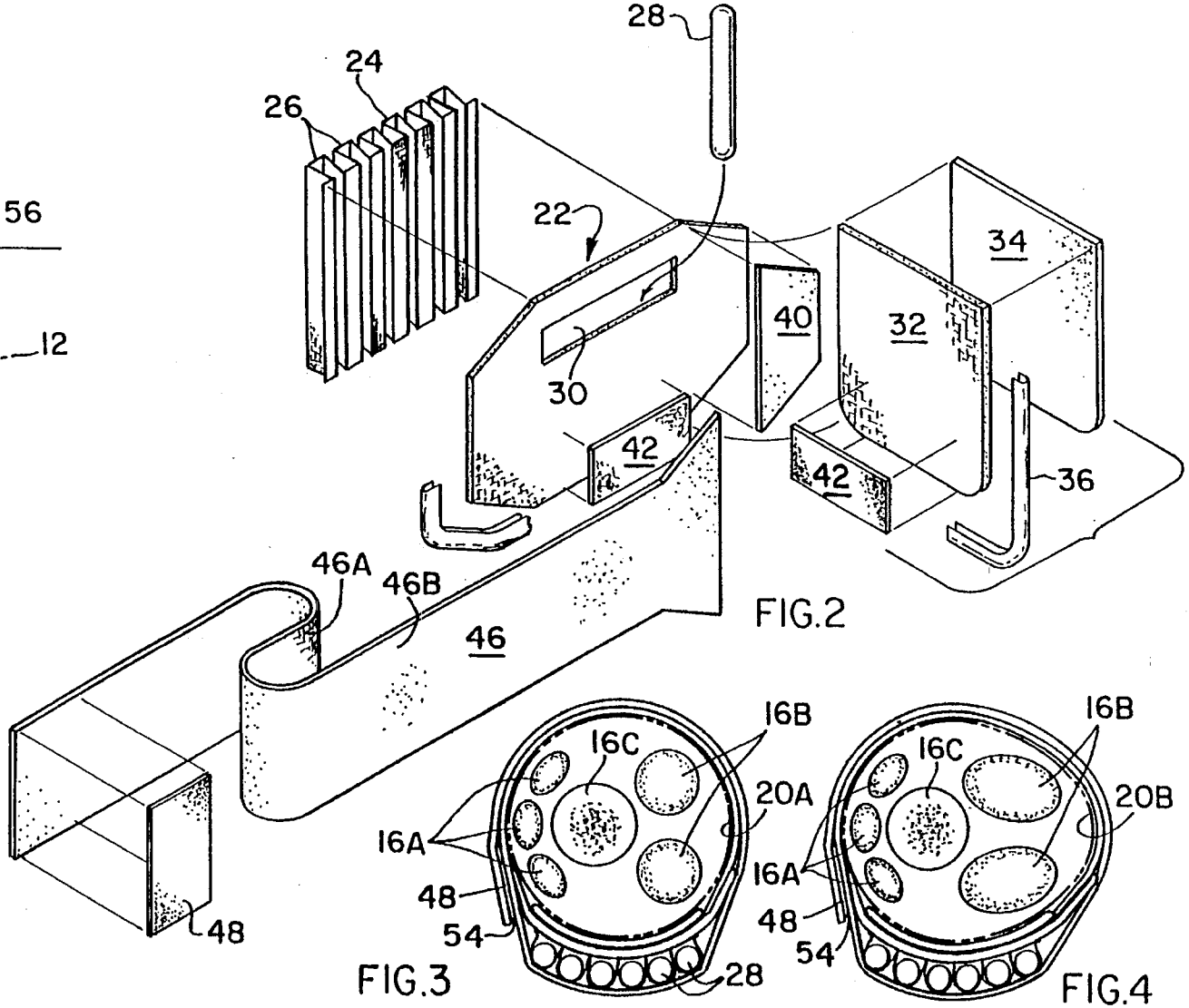
FIG.2
FIG.3
FIG.4
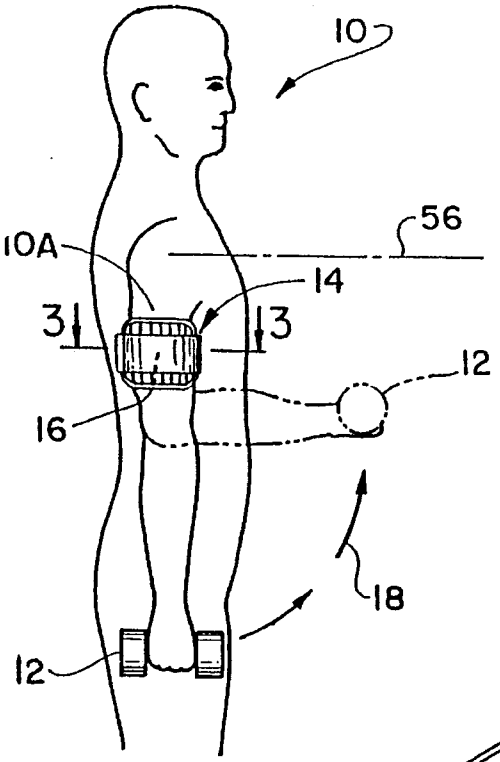
FIG.1

50
46A
23
24
26
7
22

22
23
40
36
38
34
44
46B
46
7
50
48

14A
30A
26A
28A 14
30
32
34
42
26
28
22

METHOD OF EXERCISING A SELECTED MUSCLE

This is a continuation of application Ser. No. 08/343,088, filed Nov. 21, 1994, now abandoned.

The present invention relates generally to improvements for plural weight-embodied exercising devices, the improvements, more particularly, enabling advantageous use of the exercising device for specific muscle development, as results from the direct application on the user to specific muscle locations such as, by way of example, the biceps, triceps, quadriceps, hamstrings, to mention but a few.

EXAMPLES OF THE PRIOR ART

Weights are useful in exercise routines, a common example being the use of hand-gripped dumbbells for arm and upper torso exercises. Instead of hand-gripped weights, there is also common use of wrist weights, using one or more inserted weight bars, as exemplified by the "wrist weight" of my prior patent Des. 339,838 issued on Sep. 28, 1993 which, in use, as best shown in FIG. 2, is worn in encircling relation about the wrist. Whether hand-gripped or conveniently worn on a wrist, an ankle, or even around the waist, the benefits of the exercise are not advantageously applied to specific muscle development, but rather mass development of a limb. Stated otherwise, the location of the exercising weight is selected more for gross motion and convenience in the fitting of the exercising device to the user, rather than in biceps, triceps, quadriceps, hamstring or other specific muscle development.

Broadly, it is an object of the present invention to provide an exercising device overcoming the foregoing and other shortcomings of the prior art. More particularly, it is an object to enable the device to be used in overlying position to a specific muscle, and not be necessarily limited to gross limb motion as results from a wrist, ankle or waist location.

More particularly, the inventive advance is in an exercising method using a limb-attached exercising device, the site of the attachment enabling the selection of the specific muscle to receive the benefits of the exercise and during which practice of the method there is both prior art gross or mass muscle development and also, heretofore unknown, specific muscle development.

The description of the invention which follows, together with the accompanying drawings should not be construed as limiting the invention to the examples shown and described, because those skilled in the art to which this invention appertains will be able to devise other forms thereof within the ambit of the appended claims.

FIG. 1 is a side elevational view demonstrating the within inventive exercising method;

FIG. 2 is a perspective view of a limb-attached exercise device shown in disassembled relation, which is shown in assembled relation in FIG. 1;

FIG. 3 is a cross sectional view as taken along line 3—3 of FIG. 1 illustrating the user's arm in its lower position depicted in solid line perspective;

FIG. 4 is a cross sectional view similar to that of FIG. 3, but illustrating the user's arm in its raised position depicted in phantom perspective;

Figures 5, 6, 7, 8:
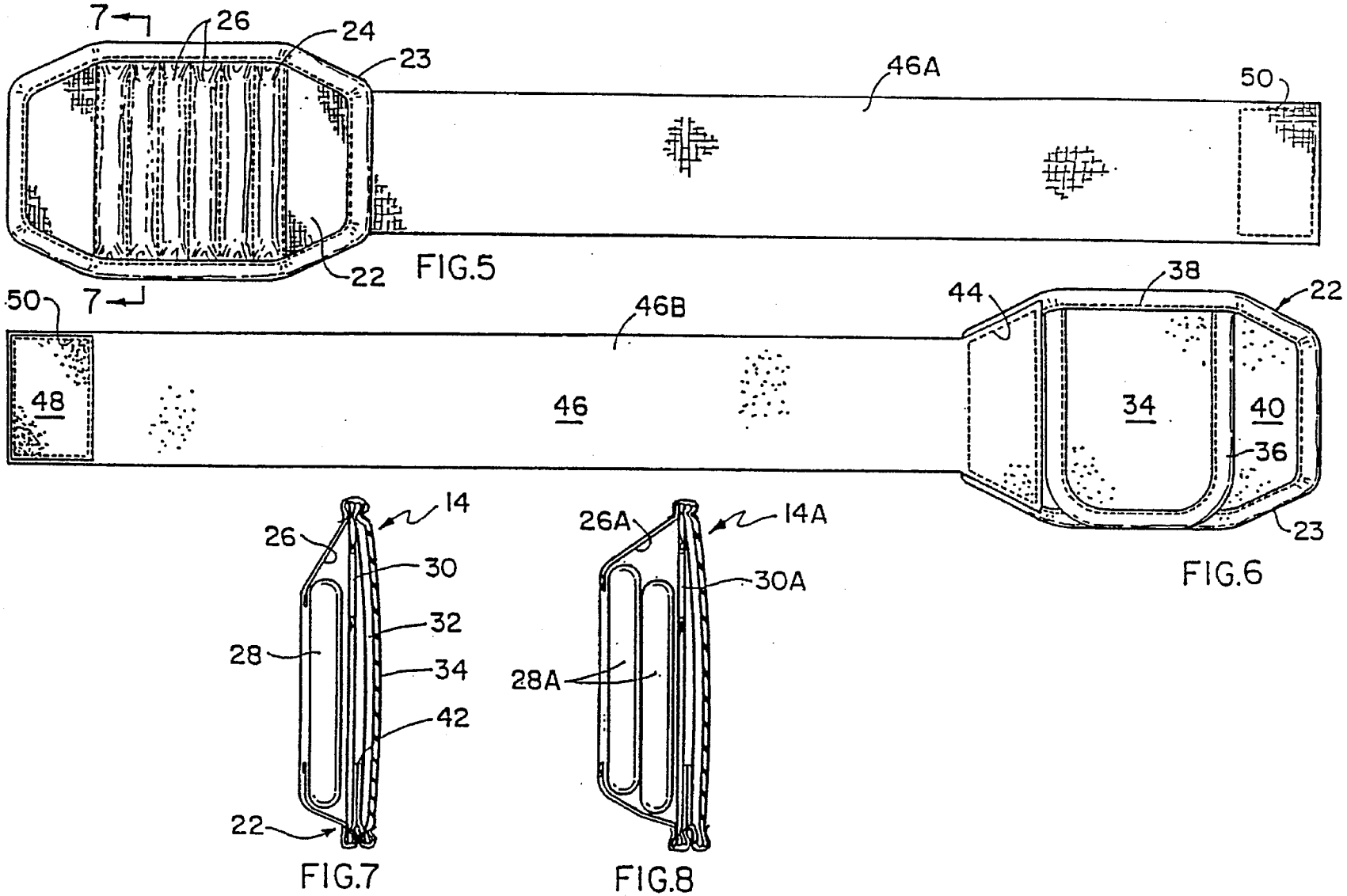
FIG. 5 is an isolated plan view of the exercise device illustrating the outwardly facing surface as worn on the user's limb.
FIG. 6 is a view similar to FIG. 5, but of the opposite surface thereof which contacts the user.
FIG. 7 is a cross sectional view as taken along line 7—7 of FIG. 5 of one embodiment of the exercise device.
FIG. 8 is a similar cross sectional view, but of a second exercise device embodiment.

The within inventive method is, as depicted in FIG. 1, an exercise routine practiced by a user 10, during which use optionally is made of a hand-held dumbbell 12 or similar exercise weight, but which will always use a limb-attached exercise device, generally designated 14, attached in encircling relation, as at 16, about the user's upper arm 10A which, as understood, is the site of the user's triceps 16A and biceps 16B muscles, as well as bone 16C as illustrated in FIGS. 3, 4.

In the raising of his arm from a lower position as shown in solid line in FIG. 1 through ascending movement along path 18 into a raised position as shown in phantom line, the user's biceps muscle 16B expands from an initial diameter size 20A of FIG. 3 into an increased diameter size 20B of FIG. 4, as may be readily noted in comparing FIGS. 3 and 4. Underlying the present invention is the recognition that muscle expansion typically occurs during exercising, not only at the upper arm site 16 but also, for example, at a thigh or calf location (not shown), and that muscle development, tone and other benefits can be made to accrue to the exerciser 10 by an exercising method which contemplates that this noted muscle expansion 20A, 20B is against a yielding resistance of a selected extent. Stated somewhat differently, the within inventive exercising method benefits the user 10 using, in addition to the exercise weight 12 which is the resistance during ascending arm movement 18, but also a resistance to muscle expansion, i.e. as depicted in progressive figures FIG. 3 and 4, as a result of the operating mode of the limb-attached exercise device 14, all as will be better understood as the description proceeds.

The exercise device 14 for practicing the within inventive exercising method is of the type, as best shown in disassembled relation of its component parts in FIG. 2 and with said component parts in assembled relation in FIGS. 5 and 6, consisting of an elongated rectangular shape, having adjacent one end a body 22, with stitch-attached edge piping 23, to one side of which body there is appropriately attached, by stitching, a folded fabric ply 24 forming pockets or gussets 26 sized to receive exercise weights 28, each of which is inserted in a cooperating gusset through an opening 30. After insertion of a selected number of weights 28 in the gussets 26, a combination fabric covered foam ply 32 and neoprene construction material ply 34 made integral by edge piping 36 into a flap, wherein the flap stitched at 38 serves as a closure for the opening 30 when folded down into an interposed position between the exercise device body 22 and the user 10. An additional neoprene patch 40 is optionally embodied in body 22 for comfort to the user 10, and cooperating hook and loop patches 42 sold under the mark VELCRO appropriately attached to the body 22 and flap 32, 34 to hold the flap in its closed position.

Attached by stitching 44 to extend laterally of the device body 22 is an adhesive lamination construction serving as a limb wrap-around band 46 consisting of an external or stretchable fabric ply 46A and an inner stretchable neoprene ply 46B, the preferred length of which band 46 is 20 inches, and not less than 15 inches even if the body, and thus the limb size of the user, is diminutive. A VELCRO hook patch 48 is attached by stitching 50 to the end of the band 46 to cooperate with the loop construction of the fabric ply 46A to achieve engagement therebetween.

The practice of the within exercising method using the exercising device 10 contemplates, as may best be understood from FIGS. 3 and 4, in conjunction with FIG. 1, selecting an initial site, such as site 16 as but one of several, for attachment of the exercising device 14 to a limb of the user. Body 22 with inserted weights 28 facing outward and with the closure flap 32, 34 in place over the opening 30, and being the body side positioned against the user, is readily held by one hand of the user against movement. With the other hand, the user will be instructed to stretch the wrap-around band 46 lengthwise, which is a degree of size variation in the hand 46 permitted by the stretch characteristics of the fabric and neoprene plies 46A, 46B. The stretching is not for sizing of the band 46 to the user's limb size, but more significantly to induce an urgency, as is well understood, in the neoprene construction material of the band to return to its initial unstretched length. With the neoprene band 46 held in its stretched condition, the user is instructed tow rap the band in at least two overlapping turns, as seen in FIGS. 3, 4, in encircling relation about the limb site 16. Engagement is then established between the VELCRO patch 48 and the underlying fabric surface, as at 54, after which the band 46 can be released and will retain its overlapping wrapped configuration. From the preceding description it should be readily understood that the induced urgency in the neoprene will exert a corresponding external pressure in a direction that is radially inwardly upon the user's encircled muscles, thereby serving, as already explained, as an exercising resistance during the expansion of these muscles while exercising.

In another embodiment of the exercising device 14A as shown in FIG. 8, each weight-receiving gusset 26A is sized to receive two, rather than just a single exercise weight 28A.

Another contemplated option, as shown in FIG. 1, is the raising by the user 10 of his arm beyond the phantom line-depicted position to the horizontal position denoted by the reference line 56, which allows the limb-attached exercising device 14 to function as the resistance for this extent of arm movement, and possibly allowing further the dispensing of the use of the hand-held exercise weight 12. The exercise routine could, of course, alternate between these ascending arm movements.

While the exercising device for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An exercising method using a limb-attached exercising device consisting of an elongated rectangular-shaped body having adjacent one end, plural exercising weights in inserted relation within cooperating gussets and having in lateral extending relation therefrom for a remainder of the length of said body, a panel of a selected length of stretchable neoprene construction material, said exercising method comprising the steps of selecting as a limb for exercising an upper arm or leg on the basis of a contemplated curl exercise movement thereof causing said limb to expand in circular girth incident to said curl exercise movement, positioning said selected length of said neoprene panel with said plural exercising weights in outwardly facing relation therefrom in partial encircling relation about an upper portion of said selected limb, stretching said panel of stretchable neoprene from said selected length to a lengthwise increased length preparatory to the attachment of said exercising device in encircling relation about said upper portion of said limb, winding in overlapped relation said panel of stretchable neoprene while in said stretched condition to an extent forming at lease two closed loops thereof about said limb, releasing said neoprene panel simultaneously while attaching an end of said band in overlapping relation to said two closed loops to cause a reduction in length to said selected length of said panel, and urging said limb in a curl exercise movement, whereby a contraction of said panel of stretchable neoprene diminishes the diameter size of said closed loops to contribute to applying external pressure resisting said curl exercise movement expansion in circular girth of muscles of said limb encircled by said exercising device.

* * * * *